US005634975A

United States Patent [19]

Josefsson

[11] Patent Number: 5,634,975

[45] Date of Patent: Jun. 3, 1997

[54] AIR DISTRIBUTION ARRANGEMENT FOR PAINT SPRAY BOOTH

[75] Inventor: Leif E. B. Josefsson, Lake Orion, Mich.

[73] Assignee: ABB Flexible Automation Inc., New Berlin, Wis.

[21] Appl. No.: 441,638

[22] Filed: May 15, 1995

[51] Int. Cl.[6] ..... B05B 15/00

[52] U.S. Cl. ..... 118/326; 454/50; 454/51; 454/52; 454/53; 454/54

[58] Field of Search ..... 118/326; 454/50–54

[56] References Cited

U.S. PATENT DOCUMENTS

| | | | |
|---|---|---|---|
| 3,216,183 | 11/1965 | Larsson . | |
| 4,290,348 | 9/1981 | Morgan et al. | 454/54 |
| 4,537,120 | 8/1985 | Josefsson . | |
| 4,894,073 | 1/1990 | Andreae | 454/54 |
| 5,063,835 | 11/1991 | Rockx | 118/326 |
| 5,153,034 | 10/1992 | Telchuk et al. | 118/326 |
| 5,173,118 | 12/1992 | Josefsson | 454/52 |
| 5,178,679 | 1/1993 | Josefsson | 118/309 |
| 5,244,499 | 9/1993 | Mazakas | 118/326 |
| 5,279,631 | 1/1994 | Pingel | 454/53 |
| 5,296,029 | 3/1994 | Neikter | 118/326 |
| 5,480,349 | 1/1996 | Kolta . | |

FOREIGN PATENT DOCUMENTS

| | | |
|---|---|---|
| 2119500 | 1/1982 | United Kingdom . |

*Primary Examiner*—Laura Edwards
*Attorney, Agent, or Firm*—Harness, Dickey & Pierce, P.L.C.

[57] ABSTRACT

An air distribution apparatus in a paint spray booth plenum for increasing the uniformity of down draft velocities from the plenum to the spray booth paint application zone. The increased uniformity of down draft velocities correspondingly increases paint transfer efficiency and minimizes paint overspray buildup in the paint application zone. The improved air distribution apparatus includes airflow regulating elements and flow directing members which cooperate to distribute airflow substantially evenly across the plenum floor and into the paint application area. In the preferred embodiment, a plurality of perforated plates and guide vanes are used to control the rate and direction of airflow in the plenum. The invention also provides for the adjustment of the rate and direction of flow through the use of slidable plates and adjustable guide vanes.

31 Claims, 7 Drawing Sheets

AIR DISTRIBUTION ARRANGEMENT FOR PAINT SPRAY BOOTH

BACKGROUND OF THE INVENTION

The invention generally relates to paint spray booths. More particularly, the invention concerns an air distribution arrangement for use in a spray booth plenum and adapted to improve the uniformity of the output airflow from the plenum into the spray booth paint application zone.

Down draft airflow uniformity is desired in order to maximize paint transfer efficiency which is a function of air velocity differences within the paint application zone. Particularly in powder spray booths, velocity differences cause overspray in high velocity areas and paint buildup on the painted object in lower velocity areas. In addition to inefficient paint transfer, overspray leads to buildup problems on booth walls and application apparatus surrounding the paint spray application area and additional costs relating to recovery and separation of the overspray.

In traditional paint spray booths, bag filters are distributed over the length and width of the plenum in order to distribute air evenly into the plenum's lower compartment. However, this arrangement has not been found to provide the desired uniformity of airflow. Further, the use of bag filters requires an upper plenum compartment containing the bag filters and a lower plenum compartment equipped with a filter media through which the air from the upper compartment must pass to reach the paint application zone.

Additional methods of minimizing overspray buildup in a powder spray booth are discussed in U.S. Pat. No. 5,178,679, assigned to the assignee of this application, and incorporated herein by reference. However, the methods discussed therein relate to air velocity control mechanisms disposed in the paint application zone. Conversely, the invention disclosed herein minimizes the velocity differences of the air exiting the spray booth plenum thereby increasing paint transfer efficiency and decreasing overspray.

SUMMARY OF THE INVENTION

The invention provides an improved plenum associated with a spray booth paint application zone. The plenum is separated from the paint spray area by a filter ceiling which allows air to pass from the plenum into the paint application zone. The plenum is further comprised of an air distribution apparatus and a plurality of plenum chambers. Air, received by the plenum through an inlet means, passes through the air distribution apparatus, into the plenum chambers, through the filter ceiling and into the paint application zone.

The present invention is directed to the air distribution apparatus within the plenum. The improved air distribution apparatus includes plenum input air flow regulating means and flow directing means to provide a uniform down draft of air from the plenum into the paint application zone. The flow regulating means operate to regulate the airflow into the air distribution apparatus whereas the air directing means direct predetermined proportions of the airflow from the flow regulating means into predetermined sections of each plenum chamber. Together, the flow regulating means and flow directing means allow both the volume and direction of airflow into the plenum chamber to be controlled.

It is preferred that the initial settings of both the flow and direction control means be made by the manufacturer to ensure substantially uniform velocity distribution through the filter ceiling for each plenum module. However, the present invention provides for adjustable flow control on both the flow regulating means and the flow directing means. Further, adjustable guide means are provided whereby the direction of the air exiting the flow directing means may be adjusted.

It is a feature of this invention that a substantially uniform air velocity distribution from a spray booth plenum and into a spray booth application zone is created thereby providing increased paint transfer efficiency and reduced overspray buildup.

It is a further feature of the invention that the spray booth plenum may be manufactured as a single chamber, preferably 7' in height, rather than the current plenum module configuration which uses a pair of overlying chambers each 5' in height.

BRIEF DESCRIPTION OF THE DRAWINGS

The objects and features of the invention will become apparent from a reading of a detailed description taken in conjunction with the drawings, in which.

DETAILED DESCRIPTION

Figure 1:
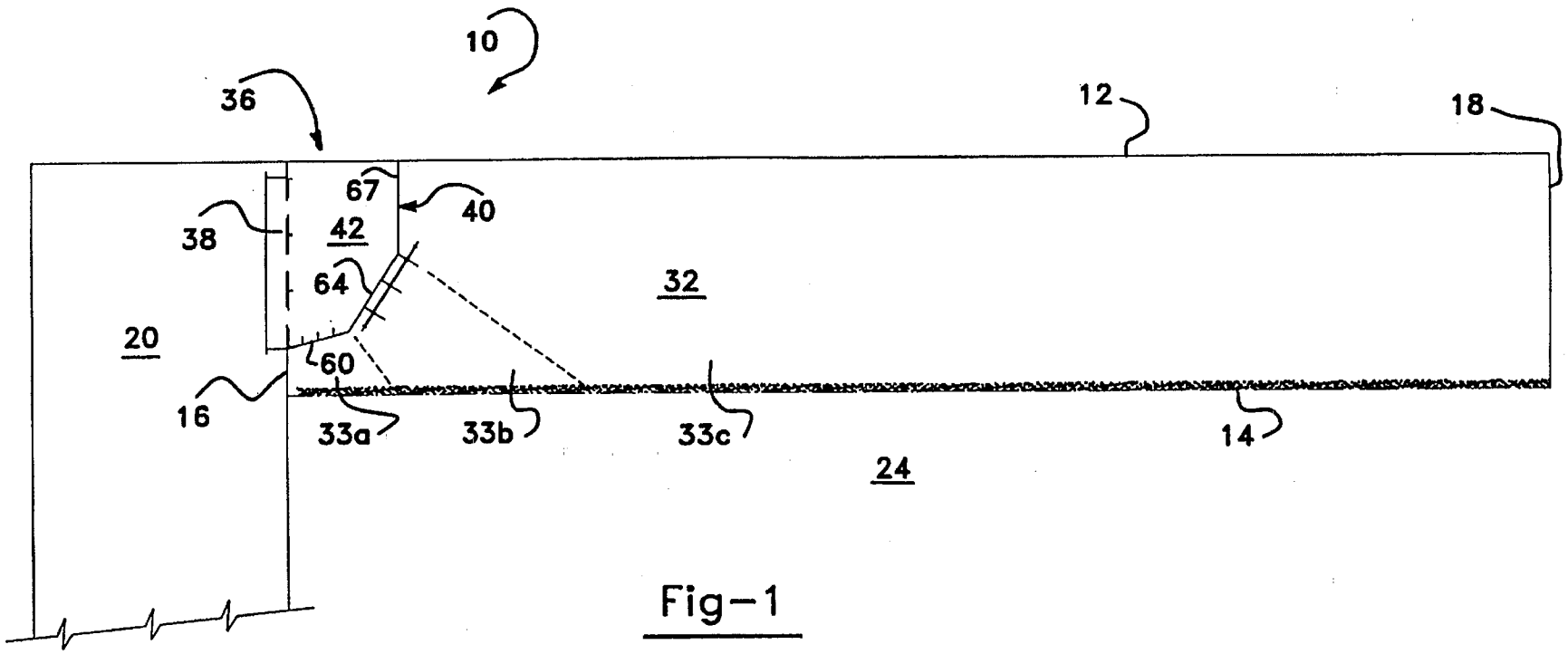
FIG. 1 is a longitudinal sectional view of a paint spray booth plenum module arranged in accordance with the principles of the present invention.
Figure 2:
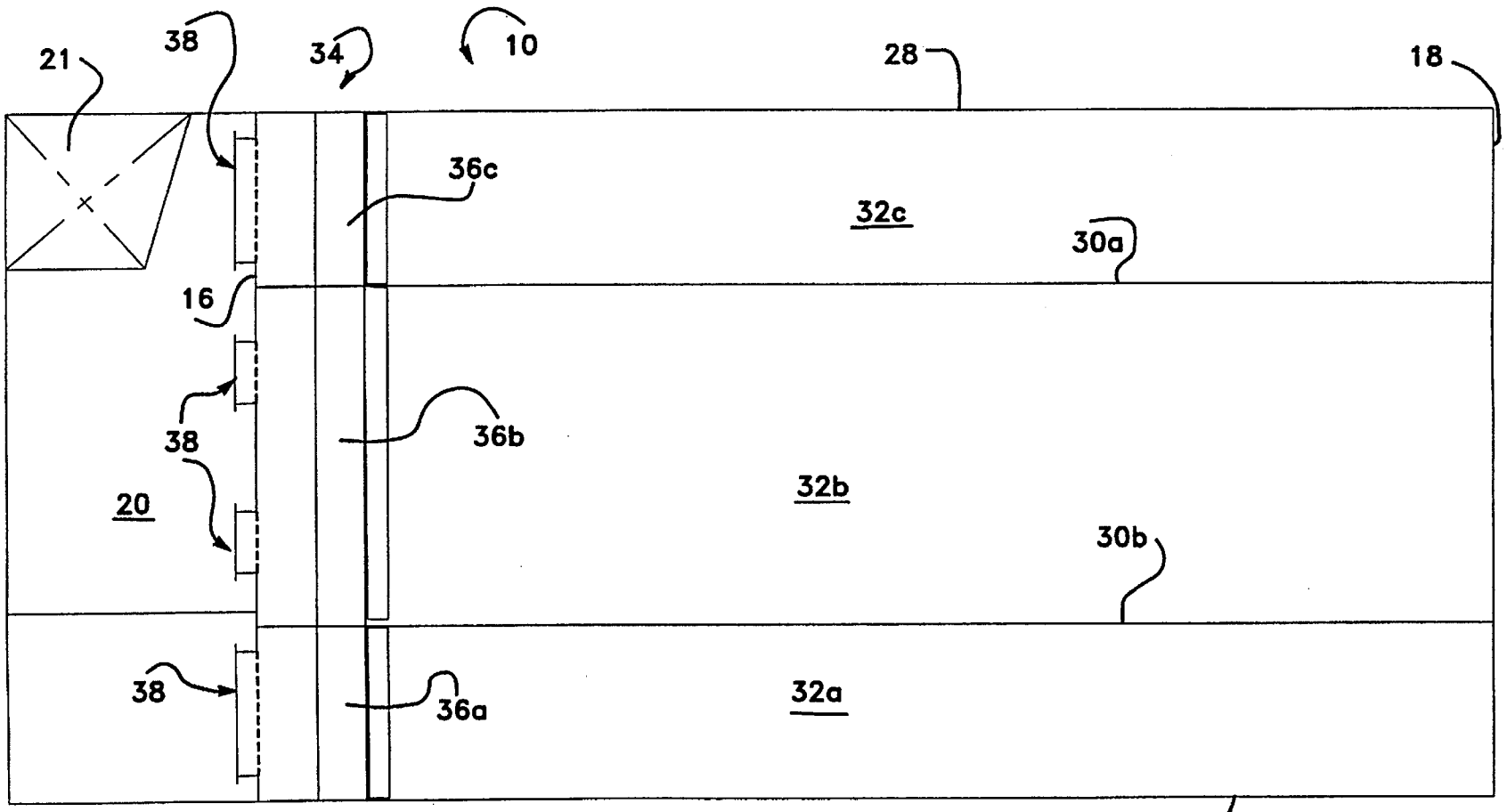
FIG. 2 is a perspective view of the paint spray booth plenum illustrating a plurality of plenum modules, plenum chambers, plenum subchambers and plenum air distribution apparatuses arranged in accordance with the present invention.

Referring now to FIGS. 1 and 2, a plenum module 10 is generally defined by plenum ceiling 12, plenum floor 14 and first and second end walls 16 and 18, respectively. Plenum module 10 is supported above paint application area 24 and is generally associated with an air inlet means 20 and an exhaust means 21. As shown in FIG. 2, plenum module 10 is further defined by first and second plenum side walls 26 and 28. Plenum 10 includes a plenum chamber 32 defined by second end wall 18, first and second plenum side walls 26 and 28 and first end wall 16 having an air distribution area 34 associated therewith. Further, interior partition walls **30*a* and 30*b* may be incorporated within plenum chamber 32 so as to define a plurality of smaller plenum subchambers such as 32*a*, 32*b* and 32*c***.

An air distribution area, generally designated 34, is disposed between air inlet means 20 and plenum chamber 32. As best seen in FIG. 1, air distribution area 34 includes an air distribution apparatus 36 having flow regulating means 38 and flow distributing means 40 defining an air distribution chamber 42 therebetween. Again, as shown in FIG. 2, plenum chambers 32*a*, 32*b* and 32*c* have corresponding air distribution apparatuses 36*a*, 36*b* and 36*c* associated therewith.

In operation, the air received through inlet means 20 flows through air distribution area 34 and into plenum subchambers 32*a*, 32*b* and 32*c* via corresponding air distribution apparatuses 36*a*, 36*b* and 36*c*. Flow regulating means 38 may be preset by the manufacturer and/or adjusted on site so as to allow a predetermined rate of airflow to enter each air distribution apparatus 36. Air from flow regulating means 38 enters air distribution chambers 42 and passes through air distributing means 40 into plenum chamber 32. As will be discussed in greater detail hereinafter, air distribution apparatus 36 acts to direct the airflow into plenum chamber 32 such that a substantially uniform rate of flow through plenum floor 14 occurs over the bottom surface area of each plenum chamber 32.

As will become apparent from the detailed discussion of the invention, the most obvious advantage of the present invention is an increased uniformity in the down draft velocity of air flowing from plenum 10 into paint application area 24 through plenum floor 14. It has been found that a 7 foot plenum height, i.e., the length of second end wall 18, keeps the lengthwise air velocity below 700 feet per minute and optimizes the uniformity of down draft velocities.

Figure 3:
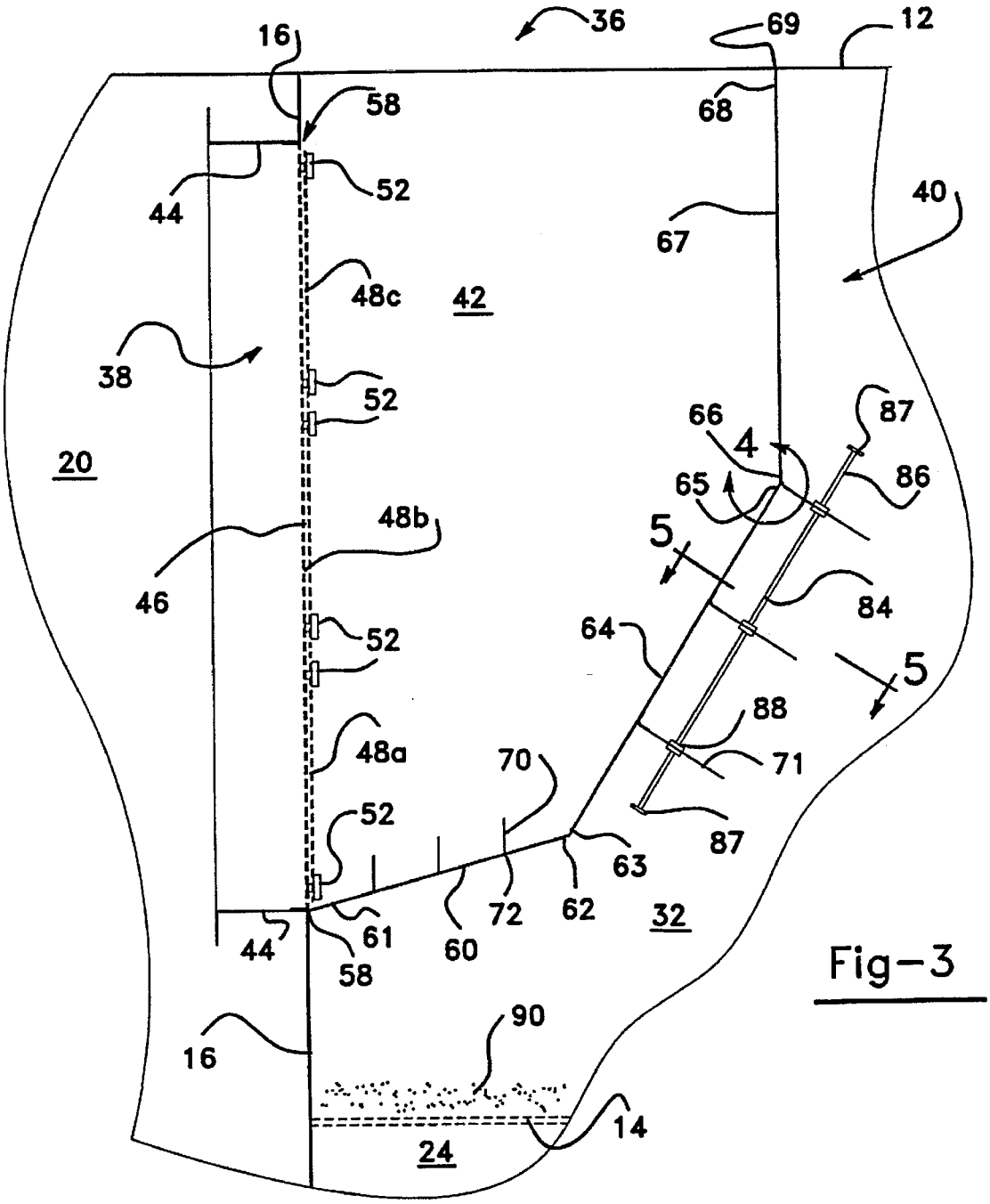
FIG. 3 is an enlarged partial view of FIG. 1 showing an air distribution apparatus arranged in accordance with the present invention.

Referring now to FIG. 3, flow regulating means 38 is shown to include an optional guide member 44 affixed to first plenum end wall 16, a first perforated plate 46 and a plurality of second perforated plates 48*a*, 48*b*, 48*c*. Flow regulating means 38 and first end wall 16 cooperate to isolate air inlet means 20 from plenum chamber 32. As will be appreciated by those skilled in the art, guide member 44 may be formed integrally with first end wall 16 or attached thereto at 58 by welding or other appropriate methods. Guide member 44 directs air from air inlet means 20 to flow substantially perpendicularly through first perforated plate 46. An array of second perforated plates 48*a*, 48*b*, 48*c*are cooperatively associated with first perforated plate 46 whereby the perforations in first perforated plate 46 which at least partially align with the perforations in the second array of perforated plates 48*a*, 48*b*, 48*c*define an open area through which air flows from inlet means 20 to air distribution chamber 42.

In the embodiment shown in FIG. 3, first perforated plate 46 is fixed relative to guide member 44 and has at least one support post 52 formed thereon. Perforated plates 48*a*, 48*b*and 48*c*form an array of second perforated plates each having at least one lost motion slot 54 (FIG. 10) sized to accommodate support posts 52 formed therein. Support posts 52 and lost motion slots 54 cooperate to slidably attach second perforated plates 48*a*, 48*b*and 48*c*to first perforated plate 46. The space shown between first perforated plates 46 and second perforated plates 48*a*, 48*b*, and 48*c* is included solely for clarity while in practice support posts 52 and lost motion slots 54 cooperate to eliminate or minimize any such space so that substantially all of the airflow through flow regulating means 38 occurs through the open flow areas of the perforations rather than between or around first perforated plates 46 and second perforated plates 46*a*, 48*b*, and 48*c*.

Figure 10:
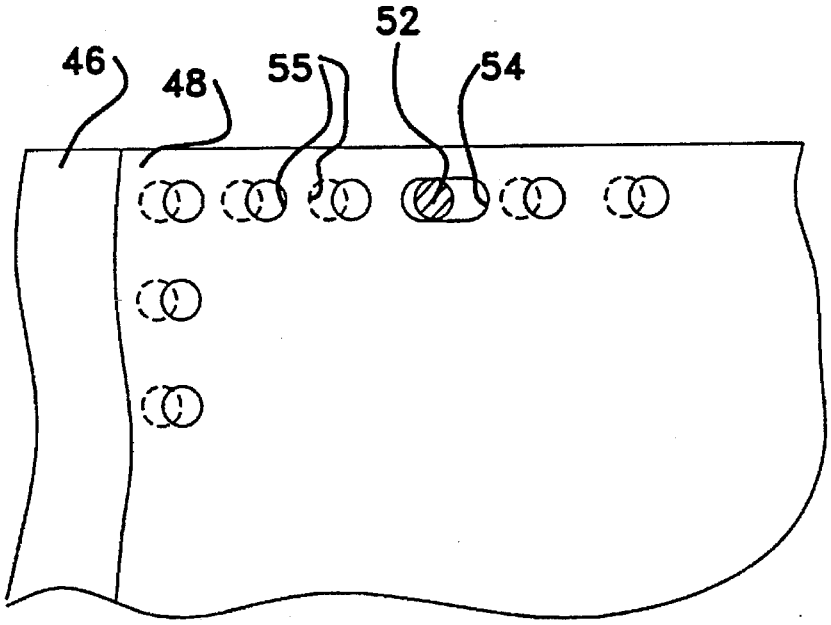
FIG. 10 is an enlarged partial view of a pair of cooperating perforated plates adapted to function as adjustable flow regulating means.

As shown in FIG. 10, lost motion slot 54 is sized to allow relative movement of first perforated plates 46 and second perforated plates 48*a*, 48*b*, and 48*c* for a distance substantially equal to or slightly greater than the width or diameter of perforations 55. Manual or mechanical movement of second perforated plates 48*a*, 48*b*, and 48*c* causes realignment of the perforations thereon relative to the perforations on first perforated plate 46 thereby redefining the open flow area of flow regulating means 38 through which air flows into air distribution chamber 42. In this embodiment, the flow rate through flow regulating means 38 can be adjusted by varying the alignment of the perforations in plates 46 and 48*a*, 48*b*, and 48*c* respectively. It will be appreciated by those skilled in the art that an infinite variety of flow rates through flow regulating means 38 may be obtained by varying the number, size, location or relative alignment of the perforations on plates 46, 48*a*, 48*b*, and 48*c*.

With reference to FIG. 3, air flowing through flow regulating means 38 exits air distribution chamber 42 through flow distributing means 40. Flow distributing means 40 generally consists of at least one perforated flow distributing member oriented within and connected to plenum 10 so as to intercept airflow from air distribution chamber 42. In the preferred embodiment shown in FIG. 3, flow distributing means 40 is comprised of three flow distributing members designated 60, 64 and 67, respectively, each consisting of a single perforated plate fixedly connected to its adjacent plate and/or plenum module 10. However, as will be apparent to those skilled in the art, other embodiments such as a single perforated plate having at least two sections adapted to provide differing airflows therethrough may be used.

Figure 5:
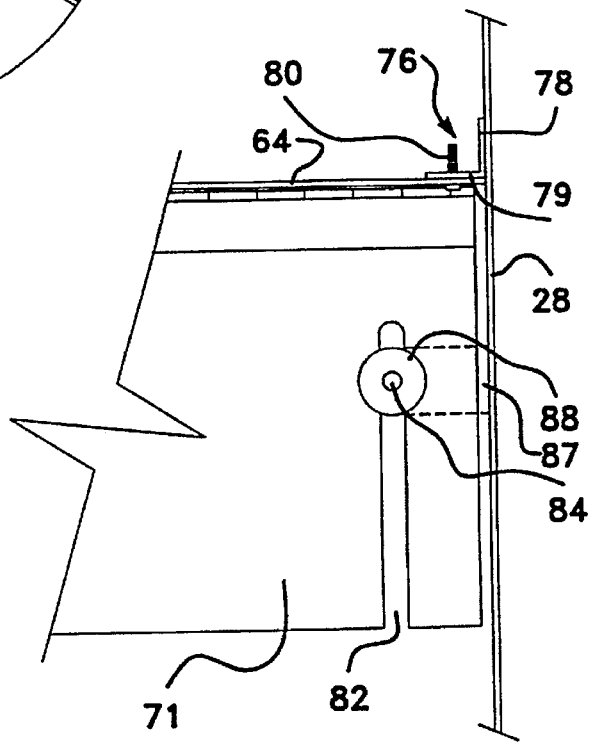
FIG. 5 is an enlarged perspective view showing a hinged guide vane having a locking mechanism associated therewith.
Figure 6:
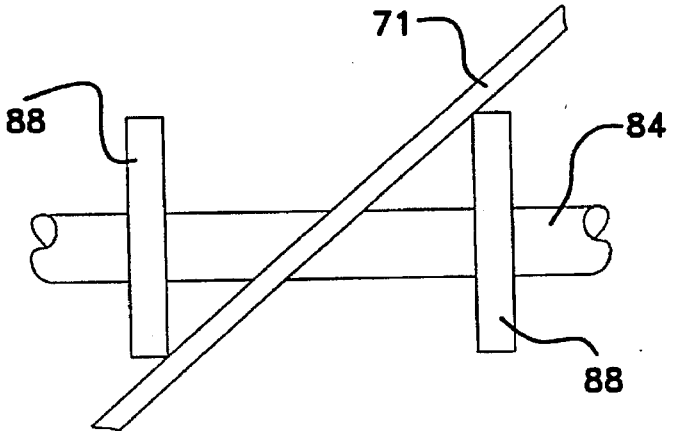
FIG. 6 is an enlarged sectional view illustrating the operation of the guide vane locking mechanism of FIG. 5.

FIG. 3 shows first flow distributing member 60 having a first end 61 connected to first end wall 16 and a second end 62 connected to first end 63 of second flow distributing member 64. Likewise, second flow distributing member 64 has a second end 65 connected to a first end 66 of third flow distributing member 67. Second end 68 of third flow distributing member 67 is connected to plenum ceiling 12 at 69. As will be appreciated by those skilled in the art, flow distributing members 60, 64 and 67 can be formed integrally with one another and integrally with plenum module 10 or the connections may be made by welding, brazing or other appropriate techniques. FIG. 5 illustrates the preferred method of connecting flow distributing members 60, 64, 67 to plenum side walls 26, 28 or partition walls 30*a*, 30*b*. Angle member 76 includes a first leg 78 connected to plenum side wall 28 and a second leg 79 having an aperture (not shown) sized to accommodate a pin 80 that connects second flow distributing member 64 to plenum side wall 28.

Flow distributing members 60, 64 and 67 may be provided with guide vanes 70, 71 which direct the air exiting air distribution chamber 42 to flow substantially parallel relative thereto. Guide vanes 70, 71 may be connected to plenum 10 so as to be located on either the upstream or downstream face of flow distributing members 60, 64 and 67 as defined by the direction of airflow relative thereto. As such, guide vanes 70, shown fixedly connected to first flow distributing member 60 at 72, direct the air exiting air distribution chamber 42 via first flow distributing member 60 to flow substantially parallel to guide vanes 70 and substantially perpendicular to plenum floor 14. Likewise, air exiting air distribution chamber 42 through second flow distributing member 64 flows substantially parallel to hingably connected guide vanes 71. The hinged connection allows for adjustment of the angular position of guide vanes 71 relative to second flow distributing member 64 thereby altering the direction of airflow therethrough.

Figure 4:
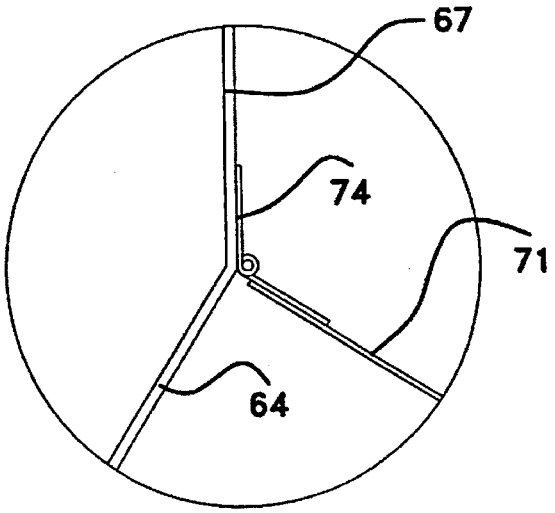
FIG. 4 is an enlarged sectional view showing a continuous hinge connection for the air distribution guide vanes illustrated in FIG. 3.

As shown in FIG. 4, a continuous hinge 74 may be used to hingably connect guide vanes 71 to flow distributing members 60, 64 and 67. Further, as best seen in FIG. 5, hinged guide vanes 71 contain slots 82 formed therein to accommodate threaded positioning rod 84 having ends 86 fixedly connected to plenum side walls 26, 28 or partition walls 30*a*, 30*b* by connecting rods 87. Each hinged guide vane 71 has a pair of collars 88 associated therewith which are threaded for engagement with the continuous helical thread of threaded positioning rod 84. The angular position of hinged guide vanes 71 relative to their corresponding flow directing member 60, 64 or 67 are adjusted by rotatably loosening each pair of cooperating collars 88, moving guide vanes 71 to their desired position and, finally, rotatably tightening collars 88 against the opposing surfaces of each corresponding guide vane. The hinged connection and methods of adjusting the angular position of guide vanes 71 shown in the preferred embodiment are for illustrative purposes only, other methods will be apparent to those skilled in the art.

In the preferred embodiment of the present invention, a substantially uniform airflow through plenum floor 14 is achieved by properly orientating first, second and third flow directing members 60, 64 and 67, respectively. As shown in FIG. 1, the airflow through first directing member 60 corresponds to the airflow into subsection 33*a* of plenum chamber 32. Likewise, the rate of flow through second and third flow directing members 64 and 67 correspond to the airflow into chamber subsections 33*b* and 33*c*, respectively. The volume of air per unit time that reaches each subsection is governed by the open flow area present in the flow directing member corresponding to each plenum chamber subsection. Therefore, when the open areas of flow directing members 60, 64 and 67 are properly sized and guide vanes 70, 71 connected thereto are properly positioned, a substantially uniform rate of airflow through plenum floor 14 may be obtained.

Plenum floor 14, a permeable member which allows air to flow therethrough, is provided with a blanket filter media 90 (FIG.3) substantially covering the full width and length of plenum floor 14. Blanket filter media 90 removes impurities from the air flowing from plenum chamber 32 into paint application area 24. Additionally, blanket filter media 90 increases the uniformity of air distribution into paint spray area 24. An adequate blanket filter media 90 provides a 0.2 inch pressure drop at an airflow rate of 100 feet per minute, however, a 0.6 inch pressure drop at 100 feet per minute has been found to maximize down draft uniformity through the plenum.

As previously discussed, it is preferred that the initial settings of flow distribution means 40, including the open area of perforated plates 60, 64 and 67 and the position of hinged guide vanes 71, be set during the manufacture of plenum 10. Presetting allows the manufacturer to test various air distribution arrangements including the number and positioning of flow directing members, the size, number and location of the perforations which define the open area of the flow directing members and the relative position of both fixed and hingably connected guide vanes for plenums of varying lengths and widths. However, the present invention as heretofore described and as shown in the attached drawings allows many of these variables to be adjusted by the user of this invention.

Figure 9:
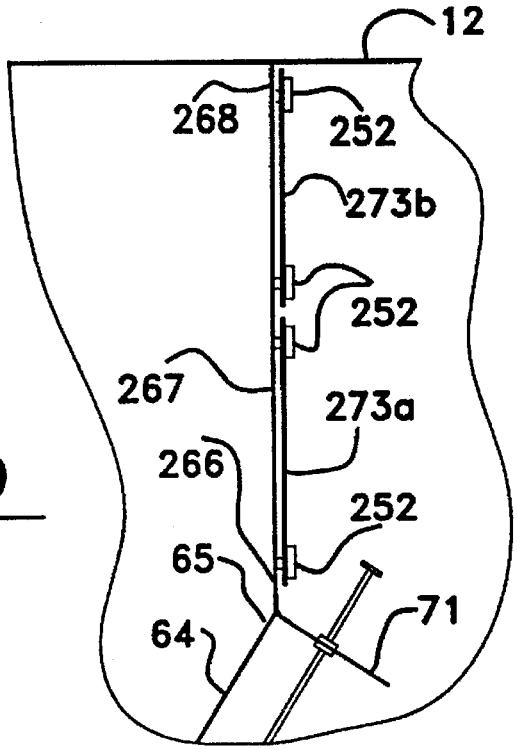
FIG. 9 is an enlarged sectional view illustrating an array of slidable plates on a flow directing member.

Additionally, the present invention allows flow directing members 60, 64 and 67 to be fitted with a pair of cooperating plates such as those previously described and set forth as plates 46 and 48 of flow regulating means 38. Third flow member 67 is shown in FIG. 9 to include a first perforated plate 267 having a first end 266 connected to second end 65 of second flow directing member 64 and a second end 268 connected to plenum ceiling 12. Fixed plate 267 also has a plurality of support posts 252 formed thereon. Perforated plates 273*a* and 273*b* form an array of second perforated plates 273 having lost motion slots (not shown) sized to cooperate with support posts 252 to allow second perforated plates 273*a* and 273*b* to slide relative to first perforated plate 267 as previously described. Such an arrangement allows the user of present invention to adjust the relative rate of flow through each flow directing member as a proportion of the total airflow through flow regulating means 38. A flow directing member having a pair of cooperating plates and hinged guide vanes would provide both volume and direction control of the airflow through the flow directing member.

Figure 7:
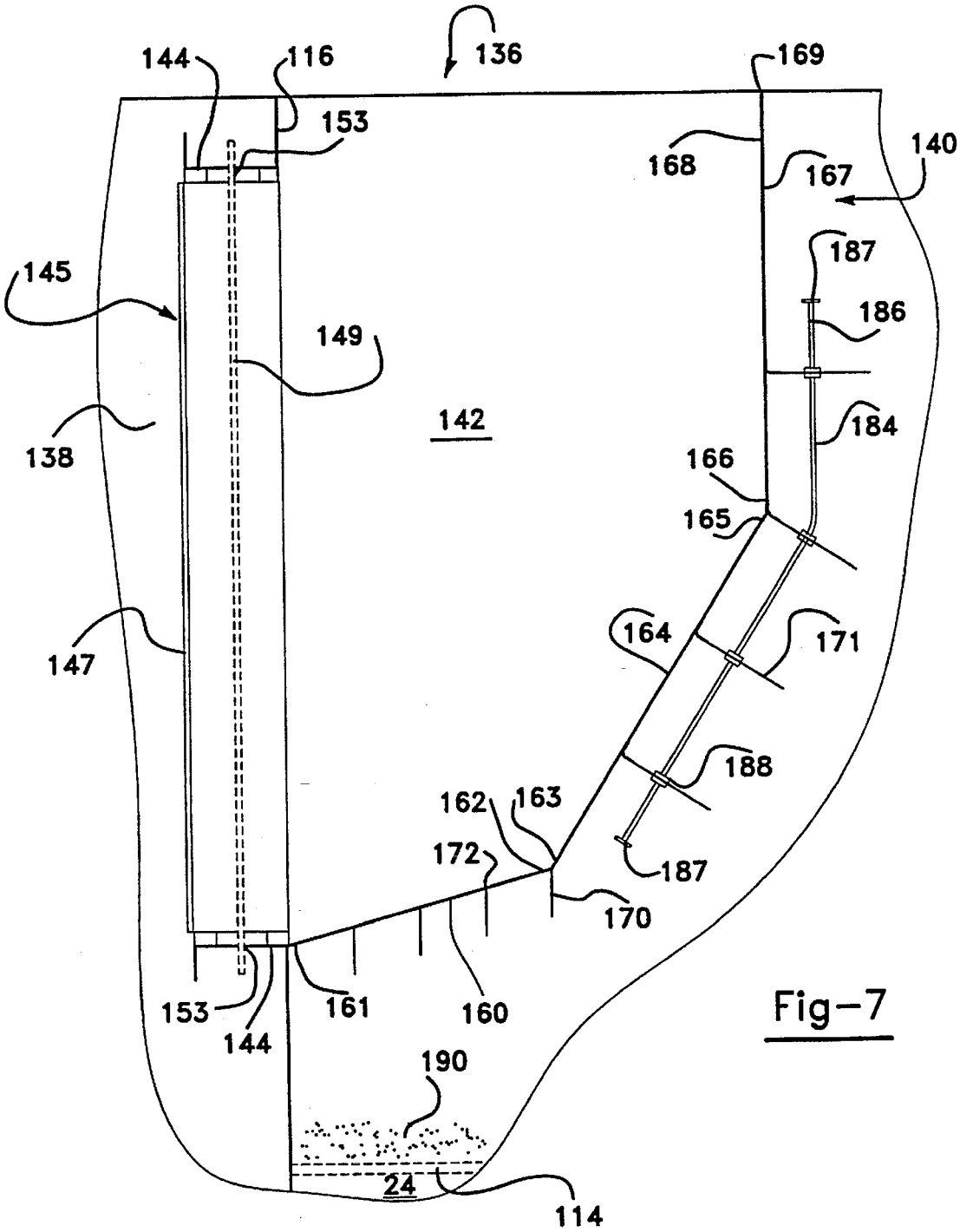
FIG. 7 is a view similar to FIG. 3 wherein a second embodiment of the present invention is illustrated.
Figure 8:
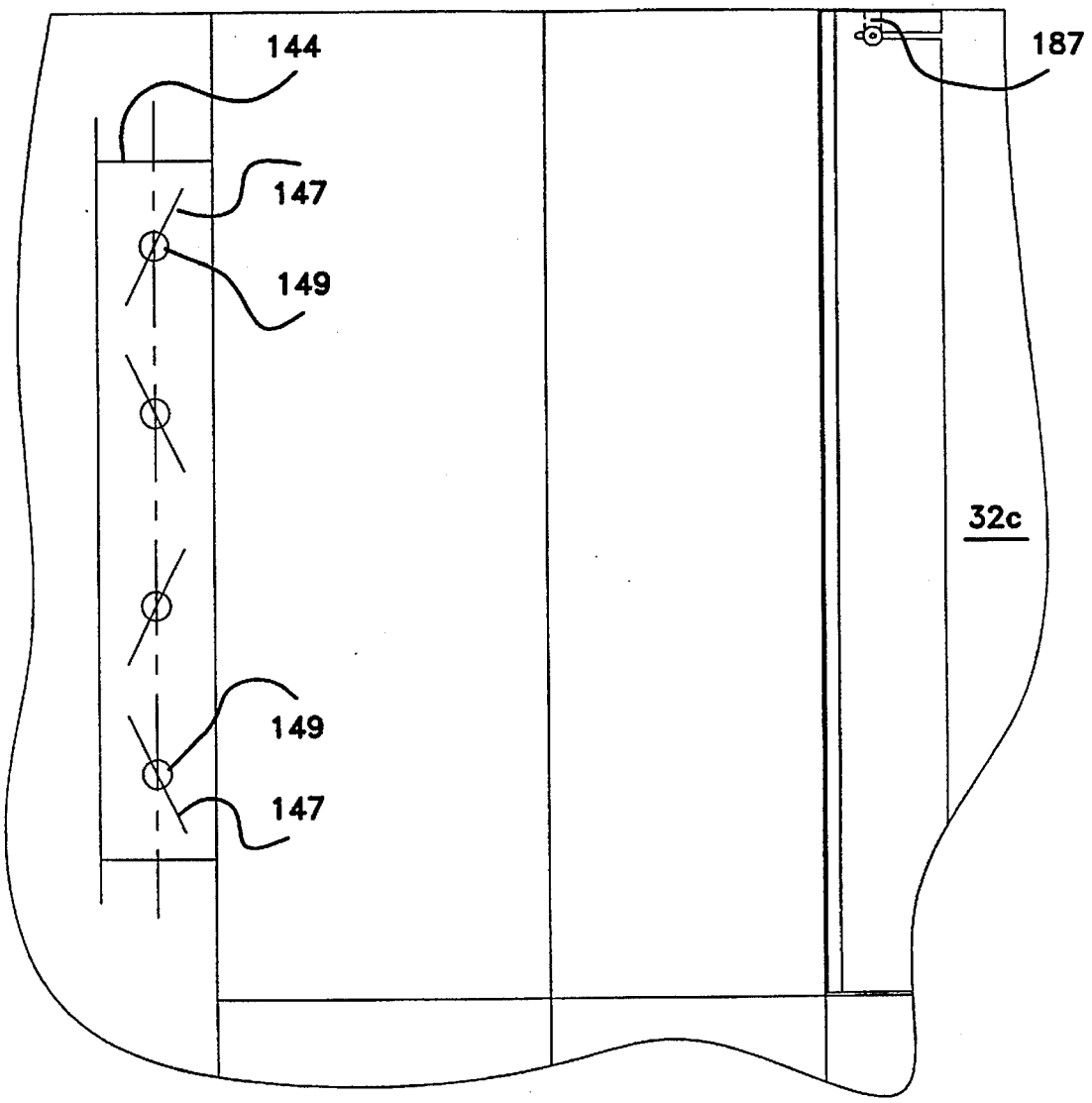
FIG. 8 is a perspective view of the second embodiment of the invention shown in FIG. 7.

Turning now to FIGS. 7 and 8, the air distribution apparatus shown therein is substantially the same as the embodiment previously discussed. Therefore, similar numerical designations are used for similar parts. However, the alternative embodiment disclosed in FIGS. 7 and 8 differs from the embodiment previously described with respect to the means used for flow regulating, the location of the fixed guide vanes on the first flow directing member and the use of a hinged guide vane on the third flow directing member.

Flow regulating means 138 contained in air distribution apparatus 136 includes a standard opposed blade damper 145 as is known in the art. Damper 145 generally includes a plurality of baffles 147 disposed for rotation on a pivot shaft 149 which, in turn, is connected to guide member 144 via an appropriately sized aperture 153 formed therein. As best seen in FIG. 8, baffles 147 are aligned in an array so as to allow modulation of the flow of air into air distribution chamber 142. As is known, pivot shafts 149 are operationally connected to a position control mechanism (not shown) which allows baffles 147 to be rotated from a fully open position to a fully closed position. In the fully open position, baffles 147 are aligned substantially parallel to the direction of airflow through flow regulating means 138 whereby the effective open flow area of flow regulating means 138 is substantially equivalent to the open flow area defined by guide means 144. In the fully closed position, baffles 147 are aligned substantially perpendicular to the airflow through flow regulating means 138 creating a minimum open flow area defined by the spaces between adjacent baffles 147.

Further, as previously discussed, FIG. 7 illustrates that guide vanes 170, 171 may be disposed on either the upstream or downstream surfaces of flow directing members 160, 164 or 167. Guide vanes 170 are shown fixedly connected to the downstream surface of first flow directing member 160 at 172. By this arrangement, air again flows through first flow directing member 160 substantially parallel to guide vanes 170 and substantially perpendicular to plenum floor 114. Third flow directing member 167 is shown to include guide vane 171 hingably connected thereto. Additionally, positioning rod 184 passes through guide vanes 171 disposed on both second flow directing member 164 and third flow directing member 167 whereby the angular position of guide vanes 171 relative to their corresponding flow directing member may be altered as previously described.

While specific embodiments of the unique air distribution arrangement for paint spray booths have been shown and described in detail in conjunction with plenum module 10, it will be understood that the present invention may likewise be readily incorporated in other air flow environments where similar flow adjusting and/or flow directing characteristics may be desired. Further, it will appreciated by those skilled in the art that the present invention may be embodied in other forms without departing from the principles and the fair scope of the present invention.

For either embodiment, it has been found that one advantageous arrangement of the flow directing members shown in FIGS. 3 and 7 include first flow directing member 60, 160 having an open flow area in the range of 2–10% of its total surface area and, further, that the perforations in second and third flow directing members 64, 164 and 67, 167 occupy, respectively, 10–30% and 20–40% of their total surface areas. This arrangement has been found most effective in achieving substantially uniform down draft velocities through plenum floor 14, 114.

Various other advantages and modifications will become apparent to one skilled in the art after having the benefit of studying the teachings of the specification, the drawings and the following claims.

What is claimed is:

1. In a paint application system including an air utilization zone and a plenum defining a plenum chamber and a surface in fluid communication with the air utilization zone for feeding airflow thereto, said plenum further including inflow means for receiving air into said plenum, wherein the improvement comprises:

an air distribution apparatus including a flow directing member and a guide member coupled to said flow directing member, said flow directing member coupled to the plenum to define a distribution chamber between the inflow means and the plenum chamber, said flow directing member including flow passages communicating with the inflow means, said guide member directing air from said flow passages into said plenum chamber and uniformly over said surface alone a first direction thereby creating a substantially uniform flow of air from said plenum to said air utilization zone.

2. The apparatus of claim 1 further including regulating means for regulating flow of air into said distribution chamber.

3. The apparatus of claim 1 wherein said flow directing member includes at least one plate having perforations defining said flow passages.

4. The apparatus of claim 3 wherein said guide member includes a guide vane associated with the at least one plate whereby flow of air through said at least one plate is substantially parallel to said guide vane.

5. The apparatus of claim 4 wherein the flow of air through said flow passages of said perforated plate defines an upstream face and a downstream face of said perforated plate and wherein said at least one guide vane is associated with said upstream face of said perforated plate.

6. The apparatus of claim 4 wherein said guide vane is pivotably associated with said perforated plate and wherein said air distribution apparatus further includes positioning means for adjusting the position of said guide vane relative to said plate and locking means for lockingly establishing the position of said guide vane.

7. The apparatus of claim 6 wherein said positioning means for adjusting includes an aperture formed in said guide vane and a positioning rod disposed in said aperture to allow adjustment of an angular position of said guide vane relative to said perforated plate.

8. The apparatus of claim 7 wherein said locking means includes a pair of locking collars associated with said guide vane for coupling said positioning rod to said guide vane and lockingly establish the angular position of said guide vane relative to said perforated plate.

9. The apparatus of claim 3 wherein said flow directing member includes a first array of perforated plates and a second array of perforated plates, one of said first and second array of perorated plates slidable relative to one another to cooperatively define said flow passages.

10. The apparatus of claim 2 further comprising a plurality of guide vanes associated with said regulating means whereby flow of air through said regulating means is substantially parallel to said guide vanes.

11. The apparatus of claim 10 wherein said plurality of guide vanes are pivotably coupled to said plenum and wherein said regulating means for regulating further includes positioning means for adjusting the position of said guide vanes and means for lockingly establishing the position of said guide vanes.

12. In a paint spray booth including a paint application area, a plenum having a surface in fluid communication with the paint application area for feeding airflow thereto, and air receiving means for receiving air into said plenum, said plenum defining plenum chamber, wherein the improvement comprises:

an air distribution arrangement including a flow directing member coupled to the plenum to define an air distribution chamber communicating with said air receiving means said air distribution arrangement further including a guide member projecting from said flow directing member, said guide member directing the airflow from said air distribution chamber into said plenum chamber and uniformly over said surface along a first direction; and a first and second array of perforated plates coupled to said plenum to communicate with the air receiving means, said first and second array of perforated plates creating a variable open area to regulate airflow from said air receiving means into said air distribution chamber.

13. The paint spray booth of claim 12 wherein said first array of perforated plates consists of at least one perforated plate connected to said plenum chamber and wherein said second array of perforated plates includes a plurality of perforated plates slidably associated with said first array of perforated plates, said first and second array of perforated plates cooperating to define a plurality of variable open flow areas through which air enters said air distribution chamber.

14. The paint spray booth of claim 13 wherein said flow directing member includes at least one perforated directing plate having perforations which define an open flow area.

15. The paint spray booth of claim 14 wherein said guide member includes at least one guide vane associated with said perforated directing plates.

16. The paint spray booth of claim 15 wherein said at least one guide vane is pivotably associated with said perforated directing plates and wherein said air distribution apparatus further includes means for adjusting the position of said guide vanes relative to said perforated directing plates and locking means for lockingly establishing the position of said guide vanes.

17. The paint spray booth of claim 16 wherein said means for adjusting includes a slot formed in each of said guide vanes and a positioning rod disposed in said slots.

18. The paint spray booth of claim 17 wherein said locking means includes a pair of locking collars associated with each of said guide vanes and adapted to connect said positioning rod to said guide vanes and lockingly establish the angular position of said guide vanes relative to said perforated directing plates.

19. In a paint spray booth including a paint application area, a plenum coupled to said paint application area and having a surface in fluid communication therewith for supplying airflow thereto, and air supply means for supplying air into said plenum, said plenum defining a plenum chamber, wherein the improvement comprises:

an air distribution apparatus including a flow directing member coupled to the plenum to define an air distribution chamber communicating with said air receiving means, said air distribution apparatus further including a guide member projecting if from said flow directing member, said guide member directing air from said air distribution chamber into said plenum chamber, said guide member being positionable to control the direction of airflow entering said plenum chamber thereby creating a substantially uniform flow of air over said surface along a first direction; and a damper coupled to said plenum, said damper positionable to regulate airflow from said air supply means.

20. The paint spray booth of claim 19 wherein said damper includes a plurality of shafts having first and second ends rotatably connected to said plenum, damper blades disposed for rotation with each of said shafts and means for rotating said damper blades from a first open position to a second closed position.

21. The paint spray booth of claim 20 wherein said flow directing member includes at least one perforated plate, said perforations defining an open flow area for each plate.

22. The paint spray booth of claim 21 wherein said guide member includes a plurality of guide vanes associated with said perforated plates whereby the flow of air through said perforated plates is substantially parallel to said guide vanes.

23. The paint spray booth of claim 22 wherein the flow of air through said open flow area of said perforated plates defines an upstream face and a downstream face of said perforated plates and wherein said guide vanes are associated with said upstream face of said perforated plates.

24. The paint spray booth of claim 22 wherein said plurality of guide vanes are pivotably attached to said perforated plates and wherein said air distribution apparatus further includes means for adjusting the position of said guide vanes relative to said perforated plates and means for lockingly establishing the position of said guide vanes.

25. The paint spray booth of claim 24 wherein said means for adjusting include an aperture formed in said guide vanes and a positioning rod disposed in said aperture to interconnect said guide vanes and allow adjustment of the angular position of said guide vanes relative to said perforated plates.

26. The paint spray booth of claim 25 wherein said means for locking include a pair of locking collars associated with each of said guide vanes to connect said positioning rod to said guide vanes and lockingly establish the angular position of said guide vanes relative to said perforated plates.

27. A plenum module for use with a paint spray booth having a longitudinal axis along which an item is conveyed for painting and a paint application area, said plenum module comprising:

a housing with a longitudinal axis said housing further including a top member, first and second ends substantially perpendicular to said longitudinal axis, a pair of side walls, and a floor member having an opening allowing air to flow from said plenum module to said paint application area;

air receiving means connected to said homing proximate to said first end of said housing; and an air distribution apparatus including a flow directing member coupled to said housing, said housing and said air distribution apparatus cooperating to define a plenum chamber and a distribution chamber, said distribution chamber located between said plenum chamber and said air receiving means, said air distribution apparatus further including control means for regulating airflow into said distribution chamber and a guide member coupled to said flow directing member for directing said airflow from said distributing chamber into said plenum chamber and uniformly over said floor member along a first direction parallel to said longitudinal axis of said housing.

28. The plenum module of claim 27 wherein said plenum chamber is defined by said top member, floor member, second housing end, side walls and air distribution apparatus.

29. The plenum module of claim 28 further including at least one partition member coupled to said housing whereby said plenum chamber is divided into a plurality of subchambers.

30. The plenum module of claim 27 wherein said control means includes a first perforated plate connected to said plenum and a second perforated plate slidably associated with said first perforated plate.

31. The plenum module of claim 27 wherein said flow directing member includes a perforated plate connected to said plenum module, said perforated plate having first, second and third sections, first guide vanes associated with said first section, second guide vanes pivotably associated with said second section and said third section, each of said second guide vanes having an aperture sized to accommodate a pivot rod and a pair of collars associated with said second guide vanes for connecting said pivot rod to said second guide vanes.

* * * * *

UNITED STATES PATENT AND TRADEMARK OFFICE

CERTIFICATE OF CORRECTION

PATENT NO. : 5,634,975

DATED : June 3, 1997

INVENTOR(S) : Leif E.B. Josefsson

It is certified that error appears in the above-identified patent and that said Letters Patent is hereby corrected as shown below:

Column 7, Line 34, Claim 1, "alone" should be --along--.

Column 8, Line 19, Claim 12, insert --a-- before "plenum".

Column 9, Line 9, Claim 19, delete "if".

Column 10, Line 12, Claim 27, "homing" should be --housing--.

Signed and Sealed this

Second Day of December, 1997

*Attest:*

Bruce Lehman

BRUCE LEHMAN

*Attesting Officer*

*Commissioner of Patents and Trademarks*